US006134999A

United States Patent [19]

Herman

[11] Patent Number: 6,134,999

[45] **Date of Patent: *Oct. 24, 2000**

[54] TRIMMING DEVICE FOR FLAT ARTICLES

[75] Inventor: John Lawrence Herman, Huber Heights, Ohio

[73] Assignee: Heidelberg Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/911,783

[22] Filed: Aug. 15, 1997

[51] Int. Cl.[7] ..... B26D 7/06; B26D 5/00

[52] U.S. Cl. ..... 83/35; 83/39; 83/404.1; 83/934; 83/956

[58] Field of Search ..... 83/934, 404, 404.1, 83/404.2, 404.3, 404.4, 407, 408, 732, 412, 422, 424, 425.2, 933, 613, 636, 694, 35, 39, 956

[56] References Cited

U.S. PATENT DOCUMENTS

| | | | |
|---|---|---|---|
| 3,153,964 | 10/1964 | Cordey | 83/407 |
| 3,570,350 | 3/1971 | Fogg | 83/404 |
| 3,688,619 | 9/1972 | Yabuta | 83/404 |
| 3,690,208 | 9/1972 | Muller | 83/934 |
| 3,733,947 | 5/1973 | Bryson et al. | 83/934 |
| 3,811,350 | 5/1974 | Marciniak | 83/39 |
| 4,048,891 | 9/1977 | Pearl | 83/528 |
| 4,384,501 | 5/1983 | Erikson | 83/425.2 |
| 4,505,173 | 3/1985 | Hartlage | 83/934 |
| 4,566,360 | 1/1986 | Lehmann | 83/934 |
| 4,606,387 | 8/1986 | Weislogel et al. | 83/733 |
| 4,615,249 | 10/1986 | Geiser | 83/934 |
| 4,841,822 | 6/1989 | Gerber | 83/174 |
| 5,095,793 | 3/1992 | Button | 83/628 |
| 5,437,215 | 8/1995 | Hamilton | 83/956 |
| 5,752,423 | 5/1998 | Rawson | 83/956 |

FOREIGN PATENT DOCUMENTS 0330729 9/1989 European Pat. Off. .

*Primary Examiner*—Kenneth E. Peterson
*Assistant Examiner*—Stephen Choi
*Attorney, Agent, or Firm*—Tarolli, Sundheim, Covel Tummino & Szabo L.L.P.

[57] ABSTRACT

The present invention is related to a trimming station for sheet like articles comprising a first conveyor assembly (2) conveying sheet material (3) in a first orientation (4) having a first trimming section (16) with vibrating trimming elements (19, 20). Further, a sheet material reorienting section (23) is provided for the sheet material (3). Reoriented sheet material articles (3) are conveyed in a second orientation (25) to a second conveyor assembly (24) having a second trimming section (33) with trimming elements (34, 35).

15 Claims, 2 Drawing Sheets

TRIMMING DEVICE FOR FLAT ARTICLES

FIELD OF THE INVENTION FIELD

The present invention is related to a trimming device for flat products being conveyed on a conveyor system, the flat products being a bundle of sheets, books, magazines or sheet material assemblages and the like.

BACKGROUND OF THE INVENTION

U.S. Pat. No. 3,811,350 is related to a sheet material trimming method and apparatus. This apparatus trims sheet material assemblages along face, head and foot edge portions. It includes a face knife located at a first trimming station and head and tail or foot knives located at a second trimming station which is spaced from the first trimming station. After a sheet material assemblage has been registered in a predetermined orientation relative to the knives at the first trimming station, the sheet material assemblage is clampingly gripped adjacent to its head and foot portions by two parallel sets of positively driven conveyor belts, i.e. timing belts, which extend from the first trimming station through the second trimming station toward a delivery station. After a sheet material assemblage has been gripped at the first trimming station by upper and lower belts of each set of conveyor belts, the face knife trims the face edge portion of the sheet material assemblage. An intermittent drive mechanism is then activated to drive the conveyor belts through a feed stroke to move the sheet material assemblage from the first trimming station to the second trimming station. At the same time, a next succeeding sheet material assemblage enters the first trimming station and is registered in a predetermined orientation relative to the knives. All three of the trim knives are then simultaneously moved through trimming strokes to the head and trail or foot edge portions of the leading sheet material assemblage at the second trimming station and to trim the head and trail portions of the leading sheet material assemblage at the first trimming station.

The conveyor belts clampingly hold the leading sheet material assemblage in registered orientation relative to the knives as it is moved from the first trimming station to the second trimming station and as it is trimmed at the second trimming station. Each set of the conveyor belts is mounted in a fixed spatial relationship with the associated one of the head and foot trim knives and can be moved transversely to the path of travel of the sheet material assemblages with the associated trim knife to adjust the distance between the head and foot trim knives to accommodate sheet material assemblages of different sizes. A center trim knife is mounted intermediate the head and foot trim knives for two-up-cutting.

EP 0 330 729 A1 is related to a rotary knife paper trimmer with long life shearing surfaces for trimming thick and shingled paper products.

Significant improvements in the life of cutting knife blades and the quality of shearing of thick multiple sheet paper products are produced in a paper trimming system having two circular rotatable knives mounted to overlap at a shearing station through which the paper products are passed. Thin steel annular disc cutting blades with teeth about the outer circumference are significantly improved in life by eliminating the effects of blade warping and non-continuous mating contact with a bed knife cutting surface in an adjacent shearing relationship that is not broken by intervention of sheared paper or out of round knife surfaces or by deflection of the cutting blade away from mating surface contact by the pressure of thick or shingled paper products. Friction and wear is reduced by inclination of the cutting blade to prevent continuous rubbing against sheared paper edges. These problems are resolved by dishing and mounting the flexible annular disc cutting knife at a small angle away from perpendicular to the axes of rotation of the knives.

Up to now, the problem of trimming all edges of sheet material assemblages, i.e., at a high speed, with a high quality at low trimming elements wear have not been resolved satisfactorily. The energy needed to trim the edges of booklets, books or sheet material assemblages is still an important factor in the technical field of trimming and further improvement is desirable.

SUMMARY OF THE INVENTION

It is an object of the present invention to minimize the energy required for driving the trimming devices while still maintaining a sheet material assemblage's conveying speed at a high level.

A further object of the present invention is to exert a low force on the sheet material assemblages when transported through the trimming devices.

According to the present invention the objects given above are being solved by the features of claim 1.

The trimming elements of the present invention are vibrated. The vibration of the trimming elements generates at least sufficient energy to shear paper, but requires little energy to generate the motion of the trimming elements themselves. By having an easy replacement of trimming elements, an adjustment of the respective vibrating masses can occur and, the specific energy required for shearing paper can be adjusted to trim different paper stock, i.e. different thicknesses. Consequently, a high speed trimming of various sorts of sheet like articles can be achieved.

According to further features of the present invention, trimming sections of a trimming station are assigned to the conveying path of the respective sheet material articles to be trimmed. The trimming elements vibrate parallel to the conveying direction of the sheet material articles. In order to maintain proper registration of sheet material articles clamping elements are arranged prior to the trimming sections. These clamping elements may be rotatably mounted rollers or elements engaging the sheet material articles prior to trimming and releasing them after trimming in the respective trimming section is terminated. According to a preferred embodiment, the clamping elements are rotating rollers creating a nip through which the flat sheet material articles pass. The clamping elements may serve a second function, i.e. forming a shearing base guiding the trimming elements. The trimming elements vibrate with a given amplitude and frequency dependent upon the thickness of the respective sheet material articles to be trimmed. Counterweights assigned to the trimming elements are removably mounted to the trimming elements to allow for an adjustment of the inertial energy finally achievable with the trimming elements again-as previously mentioned dependent upon the paper stock. By this, the inertial energy of the trimming elements in a trimming section can be adjusted to exceed the energy required to shear the flat articles.

The trimming elements may be vibrating knives. In each of the respective trimming sections, the knives are arranged in pairs, one of which is oriented in the conveying direction of the sheet material articles and one of which is oriented opposite to the conveying direction of the sheet material articles. The knives oriented opposite to the conveying direction of the flat articles perform the trimming operation.

Trimming sections according to the present invention are included in finishing lines for flat articles, which may include loading devices, reorienting sections, and the like.

BRIEF DESCRIPTION OF THE DRAWING(S)

The novel features which are considered as characteristic of the invention are set forth in particular in the appended claims. The invention itself, however, both as to its construction and its method of operation together with additional objects and advantages thereof will be best understood from the following description of a specific embodiment when read in connection with the accompanying drawings, in which:

FIG. 1 shows a conveying path of sheet material assemblages, the sheet material assemblages being turned about 90° as they move along the conveying path; and FIG. 2 is an enlarged view of the trimming elements oscillated by means of a drive.

DESCRIPTION OF PREFERRED EMBODIMENT

Figure 1:
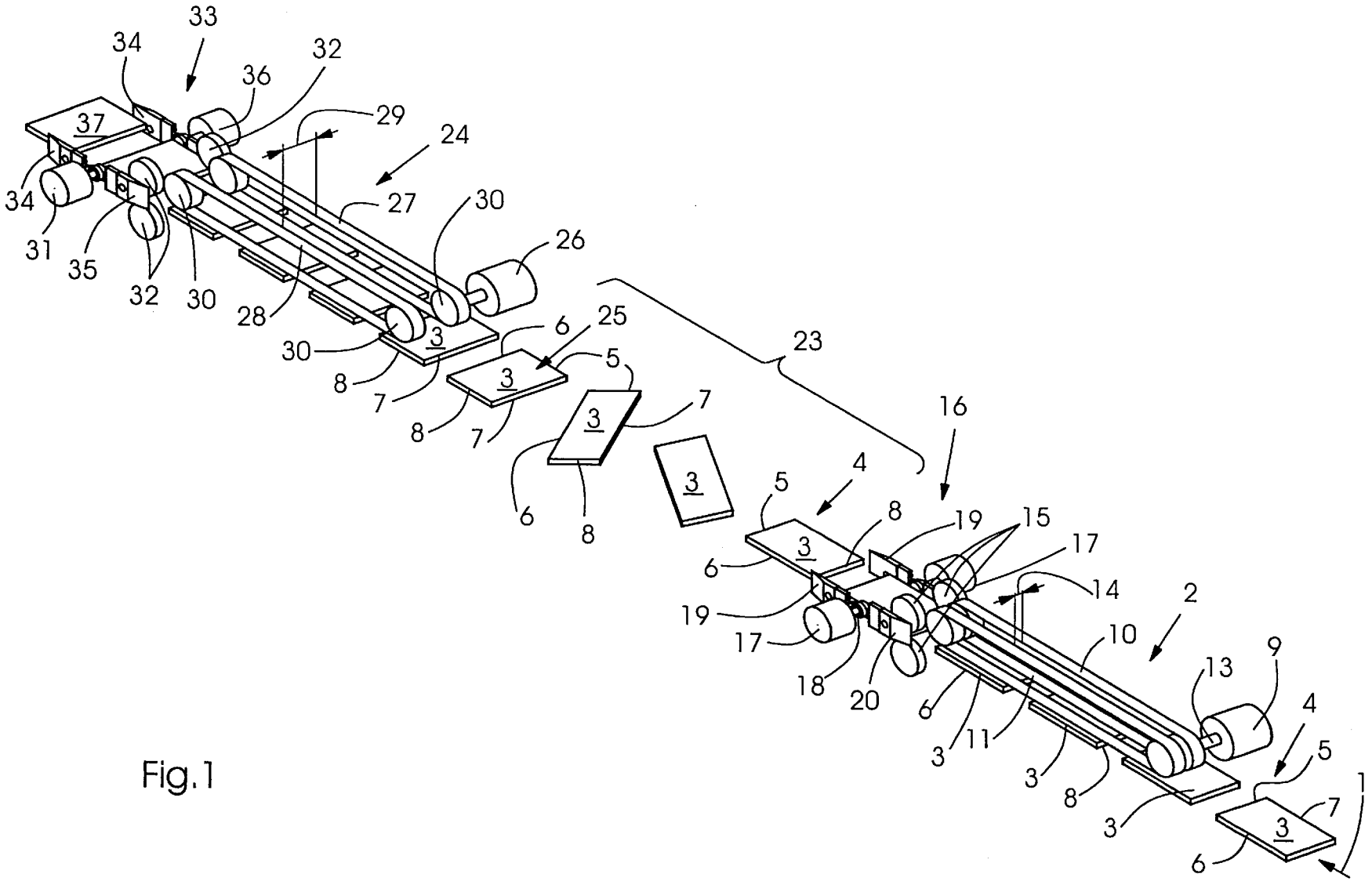

A finishing line conveys sheet material assemblages (flat articles) 3 in a conveying direction 1. The sheet material assemblages 3 may be books, magazines either glued or stitched or even more generally, bundles of sheets. In a first orientation 4, the assemblages 3 are conveyed by a first conveying assembly in a conveying direction 1. In the first orientation 4, the assemblages 3 are conveyed in the conveying direction 1 with a head edge 5 leading. A respective left side edge 6 and a respective right side edge 7 are subject to a trimming operation after the assemblages 3 have been conveyed along a first conveying assembly 2.

In the first conveying assembly 2, a first conveyor belt 10 and a second conveyor belt 11 are included each of which are driven via a drive assembly 9, 13. Both conveyor belts 10, 11 are spaced apart from each other by a belt spacing 14. The belt spacing 14 is determined by the first orientation 4 of the sheet material assemblages 3. The outer side portions of the sheet material assemblages 3, i.e., the left side edge 6 and the right side edge portion 7 are engaged by the driven first and second conveyor belts 11, 10 respectively. The flat articles 3 are forwarded by the first and second conveyor belts 11, 10 shown in the drawings of FIG. 1 such that the respective edges 6, 7 thereof are exposed to a trimming operation.

The lower support, upon which the flat articles 3 are being transported is not shown for reasons of clarification. The lower support for the flat articles 3, i.e. a lower conveyor belt is driven like the upper first and second transport belts 11, 10. By having the flat articles 3 engaged on both sides thereof the flat articles 3 are conveyed with a high degree of registration towards a first trimming section 16. Prior to the aforementioned trimming section 16, a pair of clamping devices 15 is arranged. The clamping devices 15 may either be rollers or belts to maintain true register of the flat articles 3 to be conveyed to the trimming section 16. The clamping devices 15 convey the flat articles in the conveying direction 1, but block movement of the articles opposite the conveying direction due to the trimming operation.

In the embodiment according to FIG. 1, a drive assembly 17 is assigned to both sides of the conveying path of the flat articles 3. As can be derived further from FIG. 1, the flat articles are being conveyed having a regular spacing with respect to each other. The drive assembly 17 on either side of the conveying path of the flat articles 3 acts to vibrate or reciprocate knives 19, 20 respectively, on either side of the conveying path. In a preferred mode of operation, the vibrating knives 19, 20 are reciprocating at such a frequency and amplitude, where their inertial energy is greater than the energy required to shear a paper assemblages 3. To give an example of a preferred operating mode, the knives 19, 20 vibrate through cutting and return strokes with a length of amplitude of 0.05 inches at a frequency of 4000 Hz and trim books (assemblages 3) at a speed of 24000/hour. The relationship of amplitude to frequency is such that an increase of the knives respective amplitude would cause an increase of books output per hour. On the other hand, an increase of amplitude would allow for a decrease in vibrating frequency of the respective knives 19, 20. If the respective knives 19, 20 of said first trimming section 16 are excited with a high frequency of about 4000 Hz, the energy of the drive assembly 17 driving the knives 19, 20 would be minimized. The inertial energy of the vibrating knives 19, 20 respectively could be easily adjusted by counterweights 21, 22 (shown in FIG. 2), which are removably attached to said vibrating knives 19, 20.

Upon passing through the first trimming section 16, the respective side edge portions 6, 7 of the flat articles 3 are exposed to the vibrating trimming knives 19, 20. The knives 19, 20, equipped with respective counterweights 21, 22, vibrate in a horizontal direction in the direction of movement of the flat articles 3, with an amplitude of about 0.05 inches. While vibration of the knives 19, 20 is occurring, the flat articles 3 move along their respective conveying path along the conveying direction 1. While passing the respective knives 20, a portion of the flat articles 3 is clamped by the clamping elements 15 to maintain the registration of the flat articles 3 while the articles are being trimmed and block movement of the articles opposite the conveying direction 1. Upon further conveying of the flat articles 3, the flat articles 3 are released from the clamping elements 15. Thus, the respective lateral portions on the right and left side 6, 7 of the flat articles 3 are trimmed. The flat articles 3 leave the first trimming section 16 in the first orientation 4, with the respective books or magazines or bundles 3 being trimmed.

Given the respective conveying paths of the flat articles 3, the vibrating knives 20 trim the articles while the knives 20 move opposite to the conveying direction 1 of the flat articles 3. Upon contact with the respective side portions 6, 7 of the flat articles 3, the knives 20 trim the flat articles 3. The more the flat articles 3 advance into the section of the vibrating knives 19 of the trimming section 16, the more they are being guided and moved by the knives 19, which do not contribute to the trimming operation of the flat articles 3 since the knives 19 are oriented opposite the conveying direction 1, as compared to the knives 20 which are oriented opposite the conveying direction 1.

After the flat articles 3 have been trimmed on two side portions thereof, they leave the first trimming section 16 and are subjected to a reorientation performed in a sheet material reorienting section 23, which is not part of the present invention. In order to allow for a trimming operation on either or both side portions 5, 8 respectively of the flat articles 3, which have not been trimmed yet, a reorientation of the flat articles 3 is necessary. The reorientation of said flat articles 3 can be performed by a part rotation of the flat articles 3 into a second orientation, labeled 25 in FIG. 1. After a reorientation process, the flat articles 3 enter a second conveyor assembly 24, the lead edge 5 and the foot or tail edge 8 thereof are shown exposed to a further trimming operation. In fact, only one edge 5 or 8 would be trimmed if the other edge 8 or 5 is stitched or glued.

The second conveyor assembly 24 is very similar to the first conveyor assembly 2 previously described. After the flat articles 3 have received a first trimming operation and have adopted a second orientation 25, they are conveyed along the second conveyor assembly 24. The respective flat articles 3 enter the second conveyor assembly 24 with a lateral side thereof, oriented in conveying direction 1. Since the flat articles 3 now extend over a larger width, the belt spacing 29 of a first and a second conveyor belt 27, 28 respectively of the second conveyor assembly 24 is larger as compared to the first belt spacing 14. The flat articles 3 being conveyed are transported having a regular spacing with respect to each other. Clamping elements 32 arranged prior to a second trimming section 33 have a wider spacing from each other due to the width of the flat articles 3 in their respective orientation 25. The first and second conveyor belts 27, 28 are driven by a drive arrangement 26. The respective lower support or transport device upon which the flat articles 3 are conveyed is not given here. Similar to the previously described first conveying assembly 2, the flat articles 3 are engaged between the upper conveyor belts 27, 28 and the lower counterpart thereof to maintain the flat articles 3 orientation. In the illustrated embodiment, the clamping elements 32 between which a nip is created for maintaining proper registration of said flat articles 3 are arranged to allow for a first trimming operation by vibrating knives 35 on the head edge 5 and the tail edge 8 of said flat articles 3.

The respective first and second knives 34, 35 of the second trimming section 33 are driven by a drive assembly 31, 36. The drive assemblies 17 are similar to the drive assemblier 31, 36. The knives 34, 35 are equipped with counterweights similar to those of the vibrating knives 19, 20 of the first trimming section 16. Again, a first pair of knives 34 is oriented in the conveying direction 1 of the flat articles 3, whereas the second pair of knives 35 is oriented opposite to the flat articles 3 conveying direction 1. The major part of the shearing or trimming operation is performed by the second knife 35, i.e., the second pair of knives 35 first contacting the flat articles 3 head or tail edges 5, 8 respectively. Upon first contact of the trimming elements 35 with the flat articles 3, it is important to maintain the respective flat articles 3 registration. This is performed by the clamping elements 32 engaging the respective flat articles to be trimmed. The first knives 34 arranged on both sides of the respective flat articles 3 contribute rather to guiding and conveying the flat articles 3 in the conveying direction than to the trimming operation itself.

Reference numeral 37 depicts a trimmed flat article the respective lateral edges 5, 6, 7 and 8 thereof, are trimmed.

Figure 2:
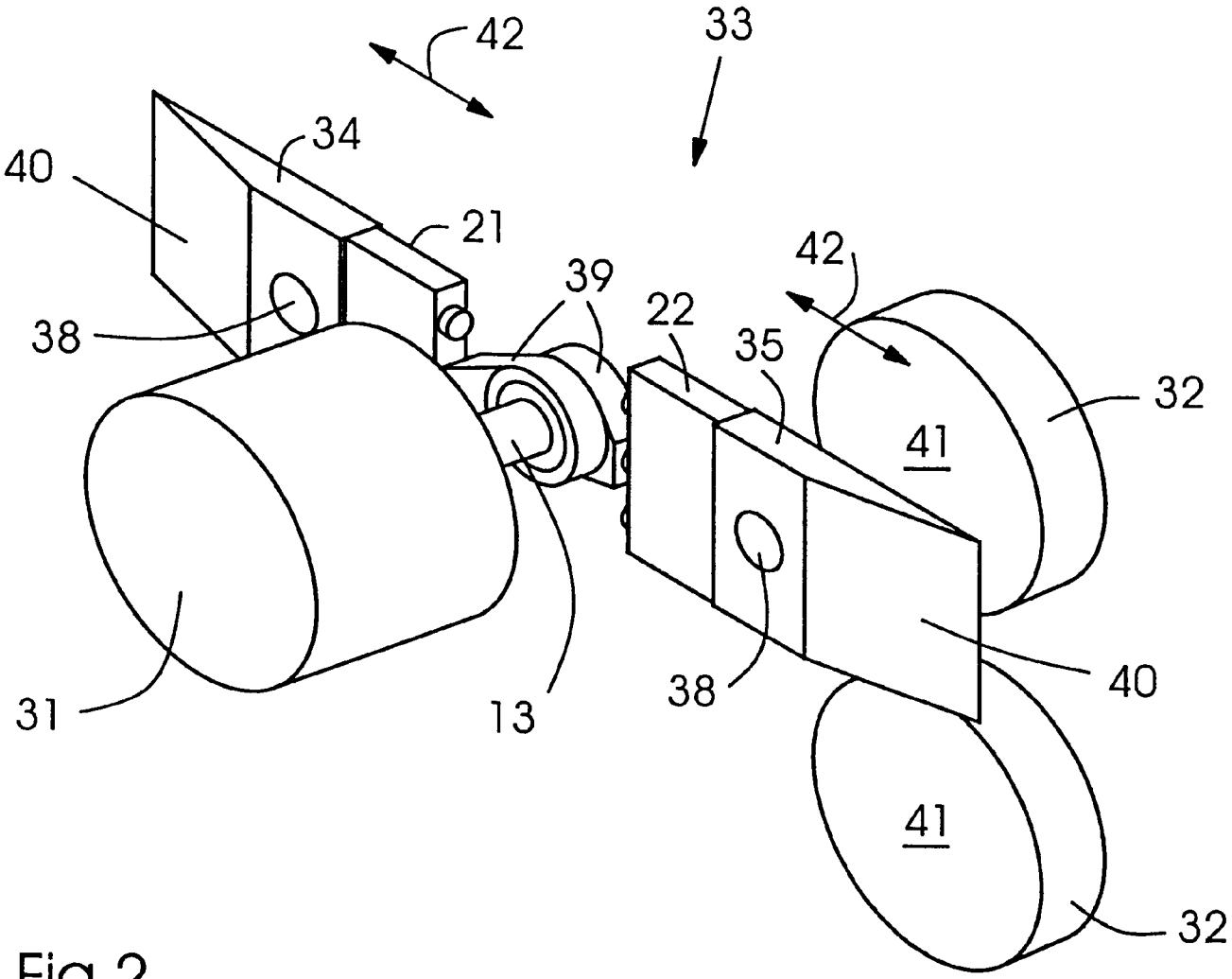

FIG. 2 of the drawing gives an enlarged view of the drive for vibrating the knives.

As can be derived from FIG. 2, the second trimming section 33 includes knives 34, 35 assigned to both sides of the flat articles 3 conveying path. The knives 19, 20, 34, 35 comprise blade shaped elements 40. Those blades 40 have a wedge shaped sharp cutting portion, which moves in a horizontal direction 42 on the respective surfaces 41 of the clamping elements 32. The knives 34, 35 having blade shape portions are mounted on respective counterweights 21, 22 which are connected by an eccentrics 39 to a drive assembly 31. By means of a bolt 38 the knives 34, 35 as well as the counterweights 21, 22 can be very easily exchanged allowing for a mass-adjustment (replacement of the counterweight and/or knife) to adjust. the inertial forces to be created to achieve a shearing operation. Depending upon the number of sheets and the thickness of the flat articles 3 to be trimmed, the frequency of the drive assembly 26 by way of magnetic devices for example can be adjusted. Further, the use of a counterweight of a certain mass or blade material for the knives 34, 35 contributes to the variation of inertial forces, which in turn minimize the energy to the supplied to the drive assembly 31, 17. Once the inertial forces are higher than the forces to shear the paper, the trimming stations 16, 33 according to the present invention trim the flat articles 3 with a minimum of additional energy required by the respective drive assemblies 31, 17 of the respective trimming section 16, 33.

The eccentrics 39 mounted on a drive shaft 13 shown here, which transfer a rotational movement into an oscillating movement, are given for example only. There exist of course other devices for vibrating the knives. The surfaces 41 of the respective clamping elements serve two functions, first, to provide a guiding and cutting surface for the vibrating knives 19, 20, 34, 35, and second, to register the respective flat articles 3 to be trimmed upon first contact of the trimming elements 20, 35, respectively. For easy exchange due to wear or different mass adjustments, the knives 19, 20 and 34, 35 have a partially hollow interior into which the counterweights 21, 22 partially extend. Both parts, i.e., the knives and the counterweights are connected to each other by means of a bolt or a screw or the like allowing for quick and easy exchange and maintenance.

From the above description of the invention, those skilled in the art will perceive improvements, changes and modifications. Such improvements, changes and modifications within the skill the of the art are intended to be covered by the appended claims.

Having described the invention, the following is claimed:

1. A trimming station for trimming sheet material assemblages having two pairs of opposite edges, said trimming station comprising:

a first trimming section with reciprocating trimming elements for trimming opposite edges of the sheet material assemblages, said reciprocating trimming elements at said first trimming section include first and second trimming knives and drive assemblies which are connected with said first and second trimming knives, a first conveyor assembly for conveying the sheet material assemblages along a conveyor path in a first orientation through said first trimming section during trimming of the opposite edges of the sheet material assemblages, said first trimming knife being disposed adjacent to a first side of the conveyor path through said first trimming section, said second trimming knife being disposed adjacent to a second side of the conveyor path through said first trimming section, said drive assemblies being operable to reciprocate said first and second trimming knives in directions parallel to the conveyor path through the first trimming section, a sheet material reorienting section for rotating said sheet material assemblages from said first orientation to a second orientation, a second trimming section with reciprocating trimming elements for trimming another edge of the sheet material assemblages, and a second conveyor assembly for conveying the reoriented sheet material assemblages along said conveyor path through said second trimming section during trimming of said other edge.

2. A trimming station as set forth in claim 1 wherein said reciprocating trimming elements at said second trimming section include third and fourth trimming knives and drive assemblies which are connected with said third and fourth trimming knives, said third trimming knife being disposed adjacent to a first side of the conveyor path through said second trimming section, said fourth trimming knife being disposed adjacent to a second side of the conveyor path through said second trimming section, said drive assemblies being operable to reciprocate said third and fourth trimming knives in directions parallel to the conveyor path through said second trimming section.

3. A trimming station as set forth in claim 1 wherein said drive assemblies are operable to reciprocate said first and second trimming knives with an amplitude of 0.05 inches and at a frequency of 4,000 hertz.

4. A trimming station as set forth in claim 3 wherein said first conveyor assembly is operable to move sheet material assemblages through said first trimming section at a rate of 2,400 sheet material assemblages per hour.

5. A trimming station as set forth in claim 1 wherein said drive assemblies are operable to reciprocate said first and second trimming knives with an amplitude of 0.05 inches.

6. A trimming station as set forth in claim 1 further including a first counterweight connected with said first trimming knife, a second counterweight connected with said second trimming knife, said first and second drive assemblies being operable to reciprocate said first and second counterweights in directions parallel to the conveyor path through the first trimming section during reciprocation of said first and second trimming knives in directions parallel to the conveyor path through the first trimming section.

7. A trimming station for trimming sheet material assemblages having two pairs of opposite edges, said trimming station comprising:

a first trimming section with reciprocating trimming elements for trimming one edge of the sheet material assemblages, said reciprocating trimming elements at said first trimming section include first and second trimming knives and drive assemblies which are connected with said first and second trimming knives, a first conveyor assembly for conveying the sheet material assemblages along a conveyor path in a first orientation through said first trimming section during trimming of said one edge, said first and second trimming knives being disposed adjacent to one side of the conveyor path through said first trimming section, said drive means being operable to [vibrate] reciprocate said first and second trimming knives in directions parallel to the conveyor path through the first trimming section, a sheet material reorienting section for rotating said sheet material assemblages from said first orientation to a second orientation, a second trimming section with vibrating trimming elements for trimming another edge of the sheet material assemblages, and a second conveyor assembly for conveying the reoriented sheet material assemblages along said conveyor path through said second trimming section during trimming of said other edge.

8. A trimming station as set forth in claim 7 wherein said reciprocating trimming elements at said second trimming section include third and fourth trimming knives and a drive means which is connected with said third and fourth trimming knives, said third and fourth trimming knives being disposed adjacent to one side of the conveyor path through said second trimming section, said drive means being operable to reciprocate said third and fourth trimming knives in directions parallel to the conveyor path through said second trimming section.

9. A trimming station as set forth in claim 7 wherein said drive means is operable to reciprocate said first and second trimming knives with an amplitude of 0.05 inches and at a frequency of 4,000 hertz.

10. A trimming station as set forth in claim 9 wherein said first conveyor assembly is operable to move sheet material assemblages through said first trimming section at a rate of 2,400 sheet material assemblages per hour.

11. A trimming station as set forth in claim 7 wherein said drive means is operable to vibrate said first and second trimming knives with an amplitude of 0.05 inches.

12. A trimming station as set forth in claim 7 further including a first counterweight connected with said first trimming knife, a second counterweight connected with said second trimming knife, said second drive means being operable to reciprocate said first and second counterweights in directions parallel to the conveyor path through the first trimming section during reciprocation of said first and second trimming knives in directions parallel to the conveyor path through the first trimming section.

13. A method for trimming sheet material assemblages having a head edge, a tail edge opposed to the head edge and first and second side edges opposed to each other, said method comprising the steps of:

conveying the sheet material assemblages along a conveyor path in a first orientation through a first trimming section with the head edges of the sheet material assemblages leading;

trimming one of the side edges of the sheet material assemblages with a first reciprocating trimming element at the first trimming section, said step of trimming one of the side edges of the sheet material assemblages includes reciprocating the first trimming element in a direction parallel to the conveyor path through the first trimming section;

reorienting the sheet material assemblages from the first orientation to a second orientation;

conveying the reoriented sheet material assemblages along the conveyor path to a second trimming section; and trimming one of the head and tail edges of the sheet material assemblages with a second reciprocating trimming element at said second trimming section, said step of trimming one of the head and tail edges of the sheet material assemblages at the second trimming section includes reciprocating the second trimming element in a direction parallel to the conveyor path through the second trimming section.

14. A method as set forth in claim 13 wherein said step of reciprocating the first trimming element includes reciprocating the first trimming element with an amplitude of 0.05 inches and at a frequency of 4,000 hertz, said step of reciprocating the second trimming element includes reciprocating the second trimming element with an amplitude of 0.05 inches at a frequency of 4,000 hertz.

15. A method as set forth in claim 14 wherein said steps of conveying sheet material assemblages along a conveyor path in a first orientation and conveying reoriented sheet material assemblages along the conveyor path include moving sheet material assemblages through the first and second trimming sections at a rate of 2,400 sheet material assemblages per hour.

* * * * *